US010194758B2

(12) United States Patent
Keyvanloo et al.

(10) Patent No.: US 10,194,758 B2
(45) Date of Patent: Feb. 5, 2019

(54) MANNEQUIN

(71) Applicant: GenesisDisplay GmbH, Auetal (DE)

(72) Inventors: Aydin Keyvanloo, Victoria (AU); Andreas Klaus Gesswein, Rinteln (DE); Liang Tung, Taipei (TW)

(73) Assignee: GENESISDISPLAY GMBH (DE)

( * ) Notice: Subject to any disclaimer, the term of this patent is extended or adjusted under 35 U.S.C. 154(b) by 234 days.

(21) Appl. No.: 15/418,625

(22) Filed: Jan. 27, 2017

(65) Prior Publication Data

US 2017/0135503 A1 May 18, 2017

Related U.S. Application Data

(62) Division of application No. 14/417,482, filed as application No. PCT/AU2013/000816 on Jul. 24, 2013, now abandoned.

(30) Foreign Application Priority Data

Jul. 26, 2012 (AU) ..... 2012903221

(51) Int. Cl.

| | |
|---|---|
| ***G09B 25/00*** | (2006.01) |
| ***A47F 8/00*** | (2006.01) |
| ***B65D 25/20*** | (2006.01) |
| ***B65D 43/16*** | (2006.01) |
| ***B65D 43/22*** | (2006.01) |

(52) U.S. Cl.

CPC ..... *A47F 8/00* (2013.01); *B65D 25/20* (2013.01); *B65D 43/16* (2013.01); *B65D 43/162* (2013.01); *B65D 43/22* (2013.01); *B65D 2543/00074* (2013.01); *B65D 2543/00833* (2013.01)

(58) Field of Classification Search

USPC .... 434/262, 267, 296, 395, 396; 446/71, 72, 446/73, 75, 76, 97, 99; 206/223, 577, 206/579

See application file for complete search history.

(56) References Cited

U.S. PATENT DOCUMENTS

| | | | | |
|---|---|---|---|---|
| 3,018,583 A * | 1/1962 | Novotney | ..... | A63H 3/005 446/73 |
| 3,660,926 A * | 5/1972 | Lerner | ..... | A63H 3/16 428/900 |
| 4,511,079 A | 4/1985 | Lopez | ..... | 206/586 |
| 4,662,518 A | 5/1987 | Chiappetta | ..... | 206/230 |

(Continued)

FOREIGN PATENT DOCUMENTS

| | | | | |
|---|---|---|---|---|
| CN | 2124571 | 12/1992 | ..... | A41H 5/00 |
| CN | 2354450 | 12/1999 | ..... | A47F 8/00 |

(Continued)

OTHER PUBLICATIONS

Chinese Office Action (with English summary) issued in application No. 201380039733.X, dated Jan. 26, 2017 (9 pgs).

(Continued)

*Primary Examiner* — Kurt Fernstrom
(74) *Attorney, Agent, or Firm* — Hayes Soloway P.C.

(57) ABSTRACT

A storage device for insertion within a cavity in a mannequin component, the storage device including a body having a receptacle for receiving items associated with said mannequin component, and a lid for closing the receptacle to enclose the items within the storage device.

16 Claims, 8 Drawing Sheets

(56) References Cited

U.S. PATENT DOCUMENTS

| | | | | |
|---|---|---|---|---|
| 4,815,999 | A * | 3/1989 | Ayon | B65D 81/3886 206/457 |
| 4,892,220 | A | 1/1990 | Foos | 206/815 |
| 4,927,025 | A | 5/1990 | Thompson | 206/223 |
| 5,238,140 | A | 8/1993 | Maze | 206/217 |
| 5,318,469 | A | 6/1994 | Unalp et al. | 446/73 |
| 5,344,004 | A | 9/1994 | Meyer | 206/1.5 |
| 5,526,707 | A | 6/1996 | Smrcka | 73/866.4 |
| 5,873,461 | A | 2/1999 | Turbett | 206/362 |
| 6,109,921 | A | 8/2000 | Yau | 132/319 |
| 6,186,852 | B1 * | 2/2001 | Davis | A45C 1/12 446/73 |
| 6,230,887 | B1 | 5/2001 | Snider | 206/232 |
| 6,257,467 | B1 | 7/2001 | Chen | 223/66 |
| 8,152,587 | B1 * | 4/2012 | Brown | A63H 3/02 206/216 |
| 2004/0200748 | A1 | 10/2004 | Klassen | 206/368 |
| 2005/0178680 | A1 | 8/2005 | Eddleston | 206/305 |
| 2006/0231438 | A1 | 10/2006 | Andrson | 206/394 |
| 2006/0243622 | A1 | 11/2006 | Lyman | 206/443 |
| 2007/0290446 | A1 | 12/2007 | Amick | 273/404 |
| 2008/0179201 | A1 | 7/2008 | Hess | 206/83 |
| 2009/0218376 | A1 | 9/2009 | King | 223/67 |
| 2010/0326850 | A1 | 12/2010 | Manlapaz | 206/223 |
| 2016/0101909 | A1 | 4/2016 | Schennum | 206/266 |

FOREIGN PATENT DOCUMENTS

| | | |
|---|---|---|
| FR | 609442 | 1/1926 |
| WO | WO2007134270 | 11/2007 |

OTHER PUBLICATIONS

Extended European Search Report issued in application No. 13823062.8, dated Mar. 14, 2016 (8 pgs).

International Search Report and Written Opinion issued in application No. PCT/AU2013/000816, dated Aug. 22, 2013 (10 pgs).

* cited by examiner

MANNEQUIN

CROSS REFERENCE TO RELATED APPLICATIONS

This application is a divisional of U.S. patent application Ser. No. 14/417,482, filed Jan. 26, 2015, which application in turn is a 371 of PCT/AU2013/000816, filed Jul. 24, 2013, claiming priority from AU 2012903221, filed Jul. 26, 2012, the contents of which are incorporated herein by reference.

FIELD OF THE INVENTION

The present invention relates to mannequins. The term mannequin covers the terms dummy, lay figure, and dress form, and is particularly relevant to mannequins for use in retail or dressmaking environments for displaying or fitting clothing.

BACKGROUND OF THE INVENTION

Mannequins are typically made from fibreglass or may be moulded from plastic, and the components are generally hollow. To assist in the transport and dressing of mannequins, the mannequins typically comprise a number of components, with parting lines being provided at the waist, at least one leg, arms and neck. This creates a torso, hip section (either alone or with one leg), one or two legs, two arms and a head. At each of these parting points, fixing mechanisms are provided to join the components together, typically by press fit or rotation of the components, with a spigot and socket arrangement.

Damage can occur to mannequins during transportation or use, either whilst dressing or once positioned on the floor. Such damage may be fixing mechanism breakage, nicks and scratches, and dents. Many mannequin manufactures provide a service or repair kit with each mannequin, and may include such items as touch up paint, repair putty, tools and additional fixing mechanisms. These are typically provided in a small cardboard box to the buyer. Inevitably, such repair kits or their components become lost or misplaced, and are not available when required. This results in the mannequin purchaser having to purchase additional repair kits when needed. It is therefore an advantageous object of the present invention to provide a solution to such situations.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

The invention has come about from the inventor's realisation that a repair or service kit could be housed within a cavity in the mannequin itself to be readily available when needed.

According to a first aspect, there is provided a storage device for insertion within a cavity in a mannequin component, the storage device including a body having a receptacle for receiving items associated with said mannequin component, and a lid for closing the receptacle to enclose said items within the storage device.

Said items associated with said mannequin component are typically repair items, such as touch up paint, repair putty, associated fixings and tools.

Preferably, the storage device further includes fixture means for securing the main body to the mannequin component. Such fixture means may be at least one screw to be received in an aperture in the mannequin component.

The receptacle may take a variety of shapes; however in a preferred embodiment the body and therefore receptacle have a cross-sectional shape resembling a symmetrical kidney. The receptacle is preferably of greater length than cross-sectional width or depth, the length extending into the mannequin component cavity.

The storage device is preferably injection moulded, advantageously out of polypropylene. The lid may be integrally moulded with the body to form a live hinge, preferably with a closing mechanism to secure closure. The lid may include a finger hole to enable opening by pulling away from the closing mechanism.

According to a second aspect, there is provided a mannequin component having at least one parting surface for joining to at least one other mannequin component, the parting surface having an opening into a void in said mannequin component, said opening being sized and shaped to receive a storage device according to the first aspect.

Advantageously, said component is a leg, arm, hip section or torso.

The parting surface of the mannequin component preferably includes a fixture plate that is secured onto or, more preferably, into the parting surface. The fixture plate advantageously includes means to fix two mannequin components together. The fixture plate preferably also includes said opening into the void of the mannequin component. The opening is preferably sized and shaped to receive the storage device, such that the storage device is substantially flush with the parting surface to allow for connection of components. The fixture plate is typically circular in shape and fits within a corresponding aperture in the mannequin component surface, and may be fixed in place by screws. The fixture plate is preferably injection moulded from a thermoplastic, such as acrylonitrile butadiene styrene (ABS), or may be formed from metal.

According to a third aspect, there is provided a mannequin having at least one removable mannequin component according to the second aspect.

According to a fourth aspect, there is provided a mannequin component having at least one parting surface for joining to at least one other mannequin component, the parting surface having an opening into a void in said mannequin component, wherein a storage device is located in said void opening, said storage device including a body having a receptacle for receiving items associated with said mannequin component, and a lid for closing the receptacle to enclose said items within the storage device.

According to a fifth aspect, there is provided a mannequin having at least one removable mannequin component according to the fourth aspect.

According to a sixth aspect, there is provided a storage device assembly, including a storage device including a body having a receptacle for receiving items associated with said mannequin component, and a lid for closing the receptacle to enclose said items within the storage device, and a fixture plate for insertion within a cavity in a mannequin component, the storage device being receivable within the fixture plate.

According to a seventh aspect, there is provided a mannequin repair kit, including a storage device for insertion within a cavity in a mannequin component, the storage device including a body having a receptacle containing repair items associated with said mannequin component, and a lid for closing the receptacle to enclose said repair items within the storage device.

Further aspects of the present invention and further embodiments of the aspects described in the preceding paragraphs will become apparent from the following description, given by way of example and with reference to the accompanying drawings.

BRIEF DESCRIPTION OF THE DRAWINGS

The invention will now be described, by way of example only, with reference to the accompanying drawings, in which.

DETAILED DESCRIPTION OF THE EMBODIMENTS

Figure 1:
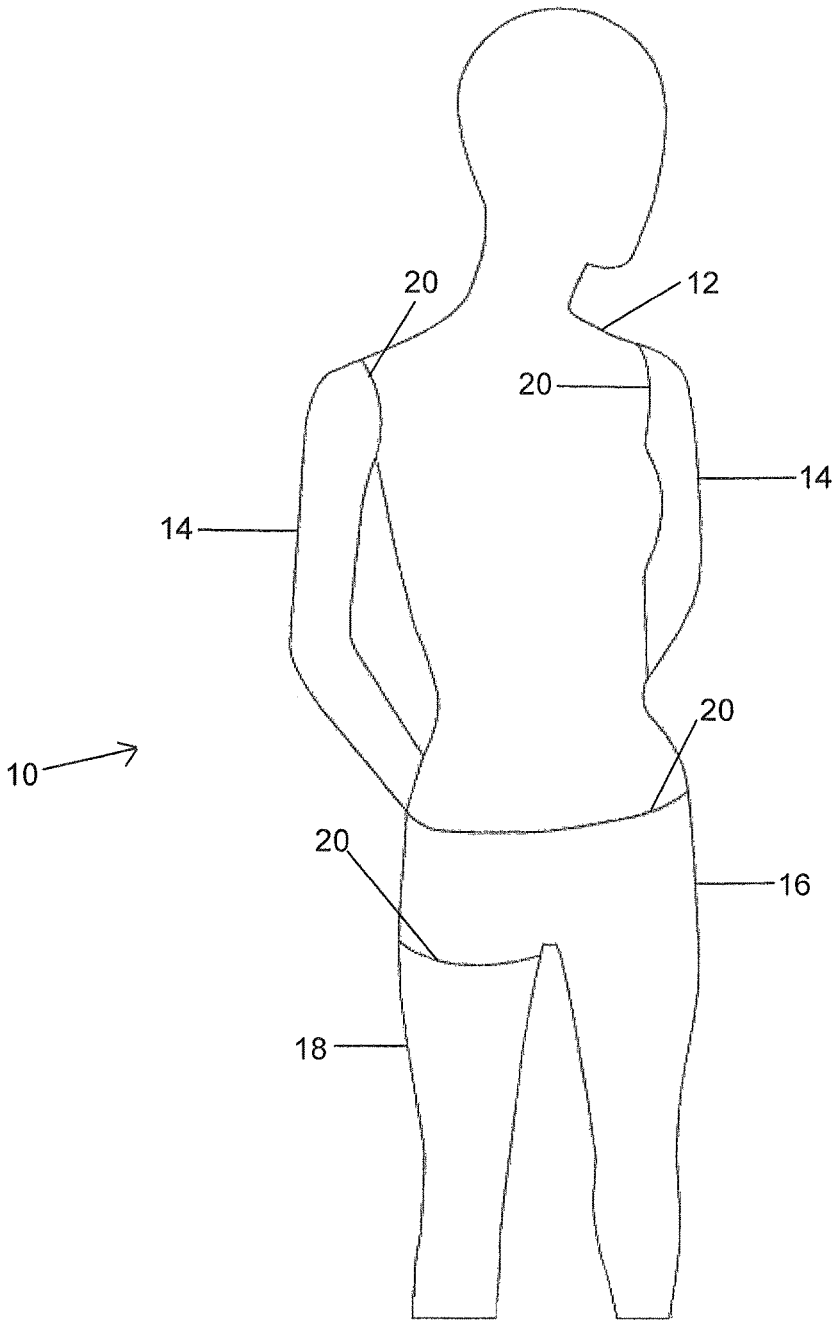
FIG. 1 is perspective view of a mannequin according to an embodiment of the third and fifth aspects of the present invention.

A mannequin 10 is shown in FIG. 1 having a torso and section 12, two arms 14, a hip and leg section 16 and a second leg 18. Parting lines 20 define the location where the mannequin components can be separated for transport or for dressing.

Figure 2:
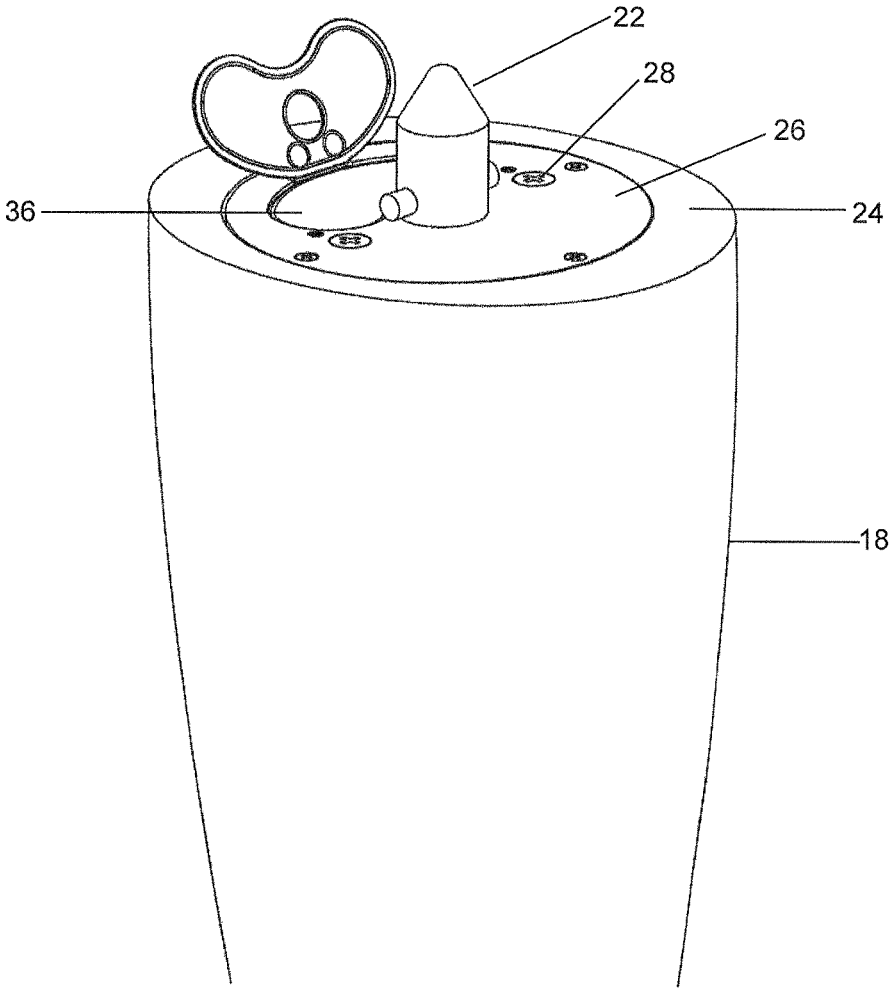
FIGS. 2 and 3 are perspective views of a mannequin component according to an embodiment of the second and fourth aspects of the present invention in the form of a leg section, with the storage device in the open and closed positions, respectively.
Figure 3:
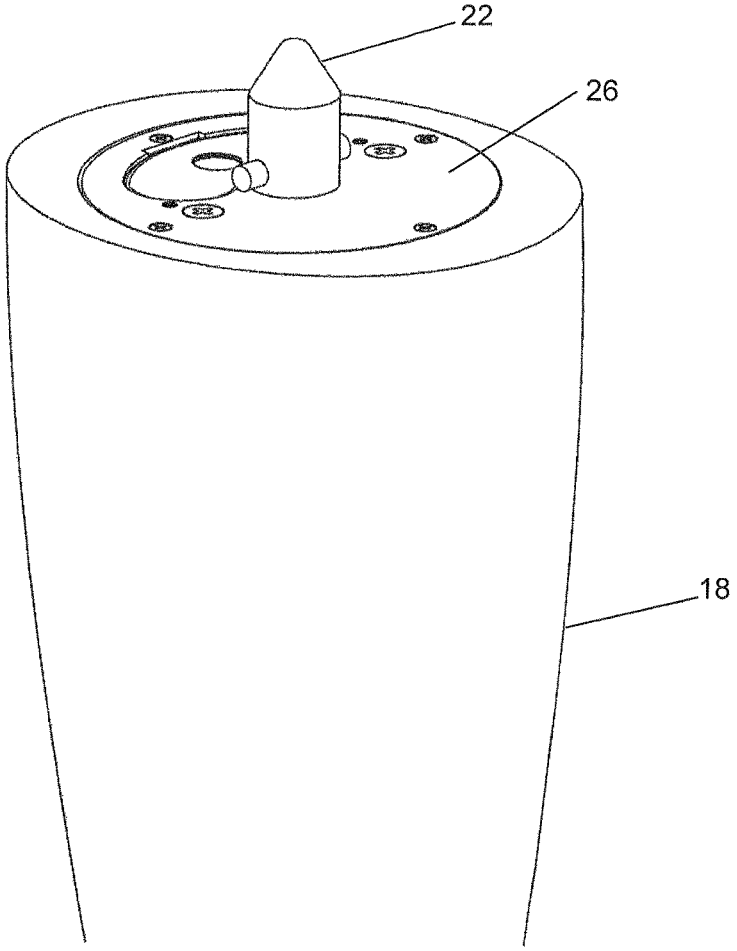
Figure 7:
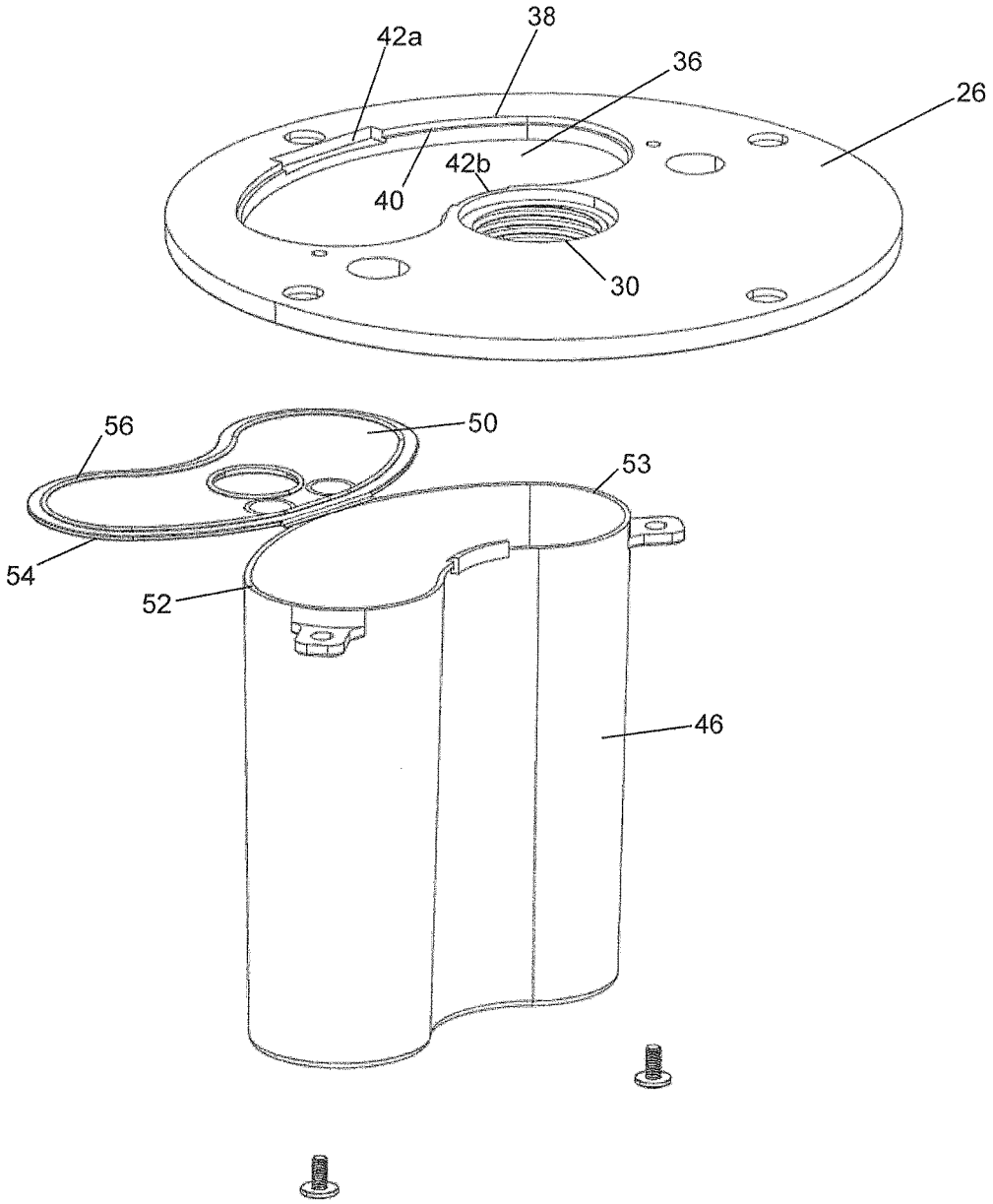
FIG. 7 is an exploded upper perspective view of a storage device assembly according to an embodiment of the sixth aspect of the present invention.
Figure 8:
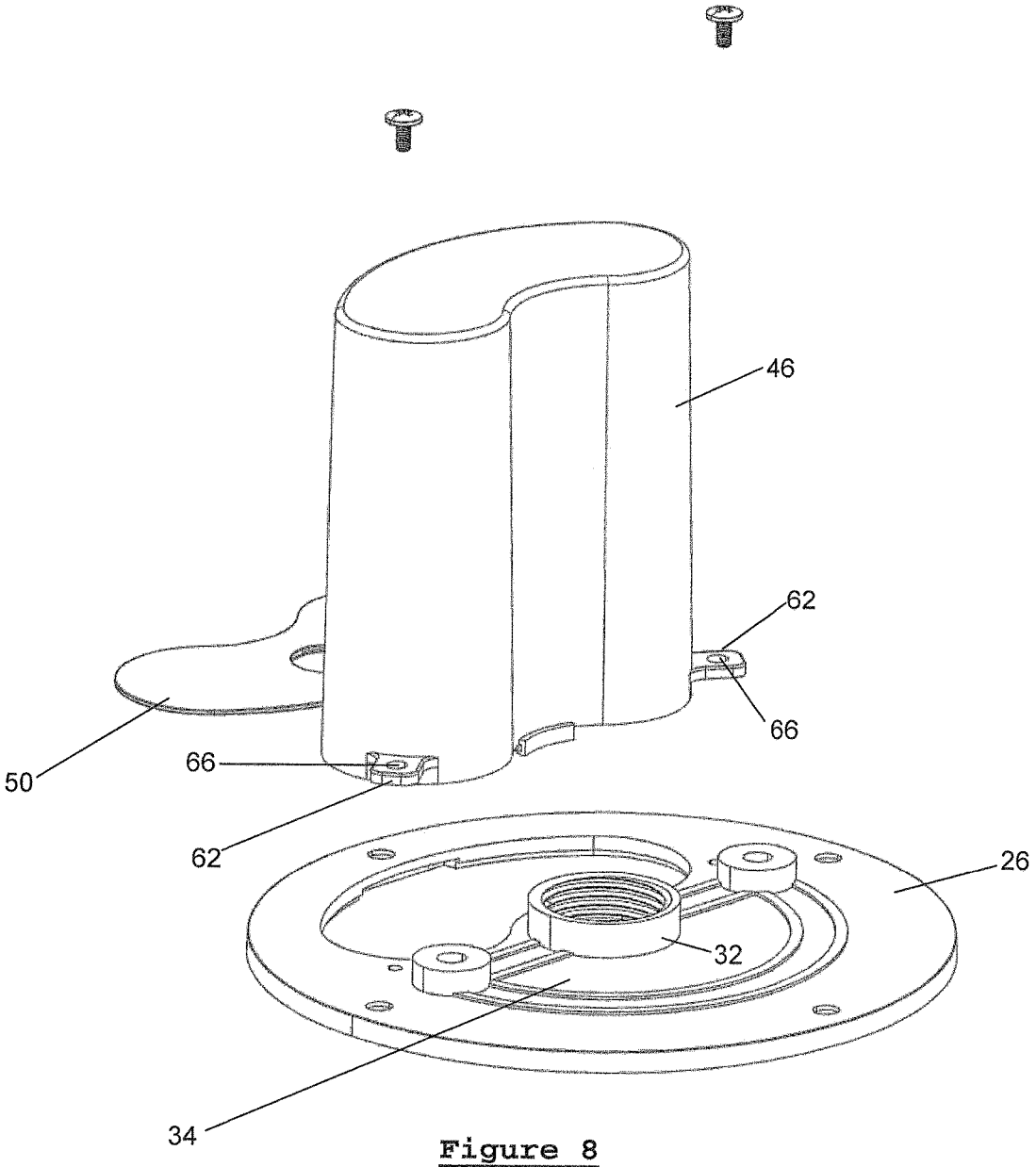
FIG. 8 is an exploded lower perspective view of the storage device assembly of FIG. 7.
Figure 9:
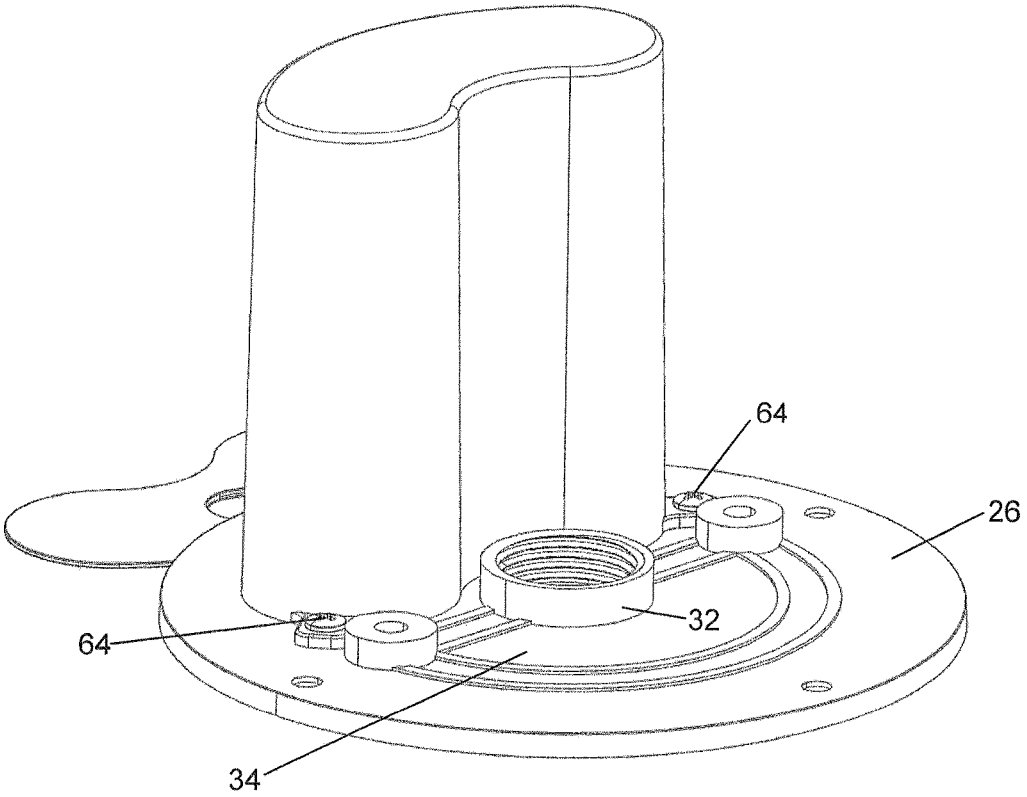
FIG. 9 is a lower perspective view of the storage device assembly of FIGS. 7 and 8.

FIGS. 2 and 3 show the second leg 18 having been separated from the hip section 16 with bayonet style fixing spigot 22. The mannequin leg component 18 has an upper parting surface 24 that mates with a corresponding lower parting surface on the hip section 16. The parting surface 24 has inserted within in it a fixture plate 26, which is secured to the parting surface 24 to create a single flush surface. The fixture plate 26 is attached as standard fixture plates are, by screws 28. As seen in FIGS. 7 through 9, the fixture plate 26 is a flat circular plate, with a plurality of screw holes and a centrally positioned aperture 30 which is threaded. As shown in FIGS. 8 and 9, a circularly projecting flange 32 extends from the underside 34 to strengthen the connection of the inserted fixing spigot 22 by creating a greater length of thread to counter lateral forces applied to the spigot 22.

Within the fixture plate 26 is an opening 36 that opens into the mannequin components internal void (not illustrated). The opening 36 is sized and shaped to receive a storage device. As best seen in FIG. 7, the opening 36 is a symmetrical kidney-shape, with its inner curve extending around the threaded aperture 30. The opening 36 includes a stepped edge 38 creating a ledge 40 extending around the perimeter of the opening 36. The perimeter of the opening 36 also includes two recessed sections 42*a*, 42*b* on opposing sides of the opening.

Figure 4:
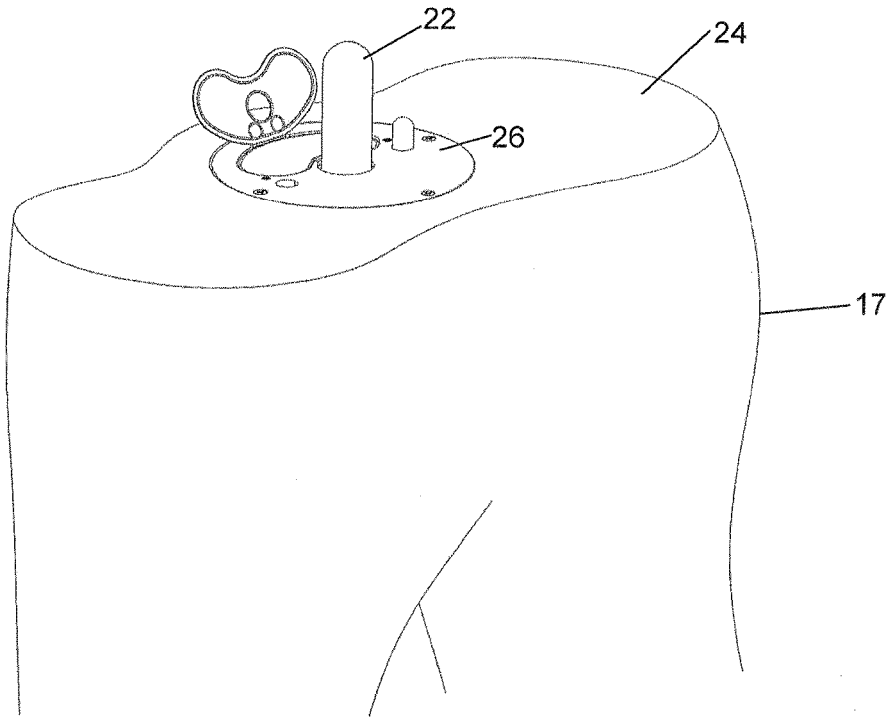
FIGS. 4 and 5 are perspective views of a mannequin component according to another embodiment of the second and fourth aspects of the present invention in the form of a hip section, with the storage device in the open and closed positions, respectively.
Figure 5:
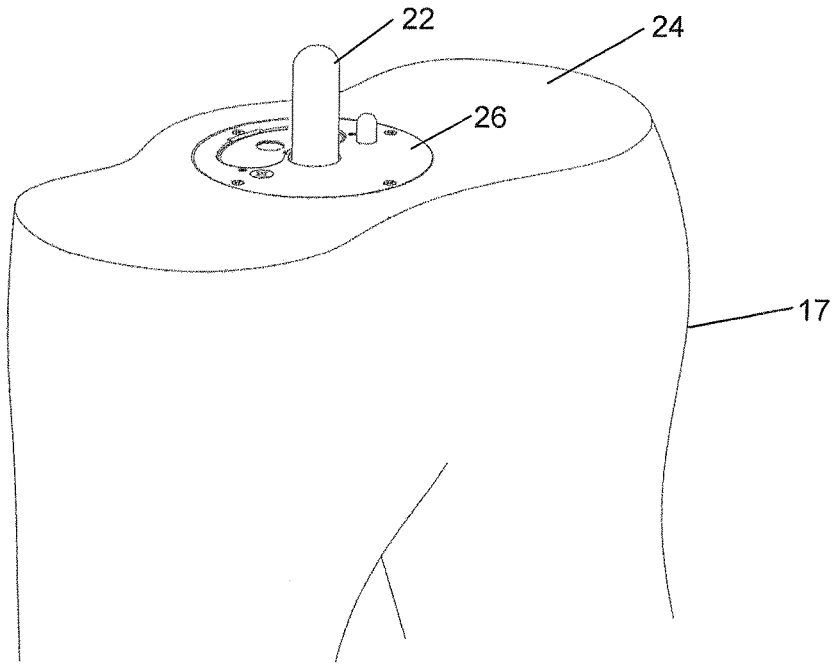
Figure 6:
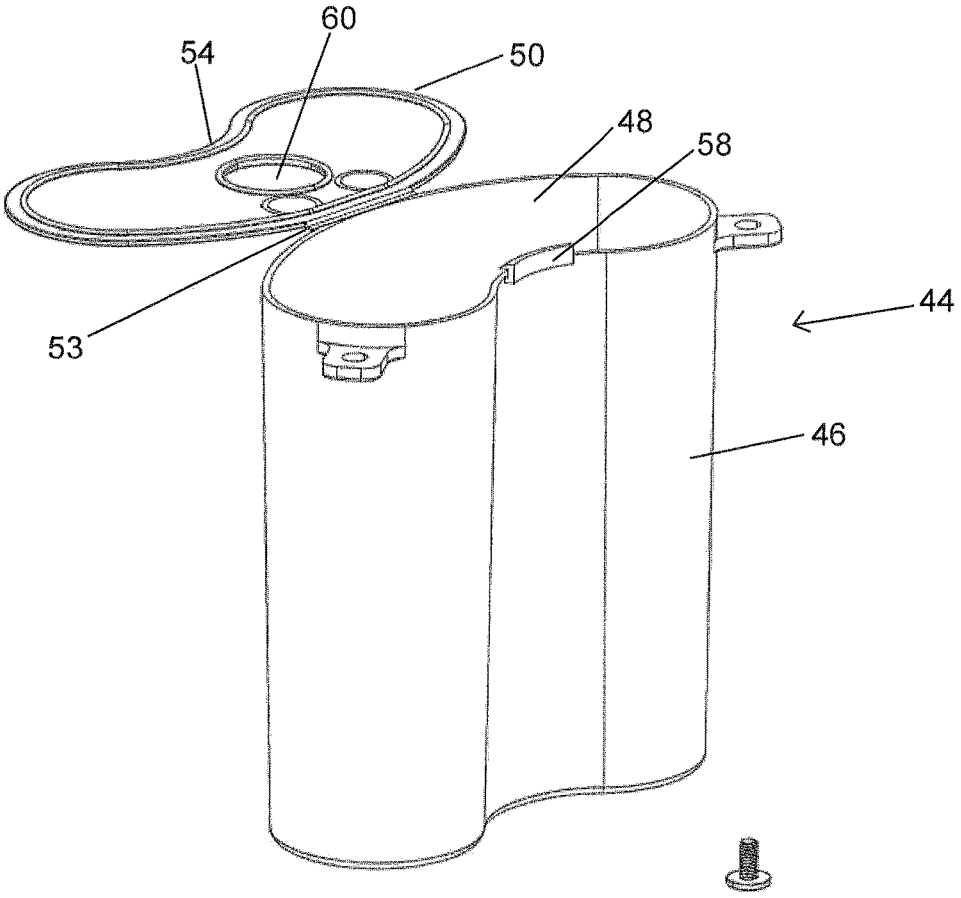
FIG. 6 is a perspective view of a storage device according to an embodiment of the first aspect of the present invention.

The storage device 44 is best shown in FIG. 6 and includes a body 46 having a receptacle 48 and a lid 50 connected to the body 46 with a live hinge 53. The body 46 is a symmetrical kidney-shape is cross-section that extends uniformly through its length. The length of the body 46 projects into the mannequin component that it is housed. An alternative mannequin component of a hip section 17 is shown in FIGS. 4 and 5, with the fixture plate 26 being centrally located in the upper parting surface 24, with spigot 22 projecting centrally. The body 46 storage device 44 therefore projects downwardly into the cavity or void within the hip section 17 moulding. The length of the body can be altered dependent on the mannequin component that it is being inserted within, or to appropriately house the items required.

Typically, the items to be housed within the storage device 44 would be items such as repair putty, touch-up paints, additional fixtures and appropriate tools. The storage device 44 could be provided as a repair kit having such items contained within them and sold as a unit.

The body 46 of the storage device 44 has an upper edge 53. The lid 50 has an outer perimeter or edge 54 that is wider than the upper edge 52 such that when closed, the edge 54 of the lid 50 extends outwardly of the upper edge 52 of the body. On the inside of the lid 50 is a downwardly extending ridge 56 matching the inside of the receptacle 48, such that when the lid 50 is closed, the ridge 56 projects into the receptacle 48 inside upper edge 52, sealing the receptacle 48. The lid 50 is secured shut by latch 58 that sides at the top of the body on the upper edge 52. The latch 58 locks over the top of the edge 54. A finger hole 60 is provided in the lid 50, which can be used to pivot the lid, pulling against and overcoming the closed bias of the latch 58.

FIGS. 8 and 9 show how the storage device 44 is inserted in the fixture plate 26 and connected. First the lid 50 is inserted through the opening 36 from the underside 34 of the fixture plate 26. The body 46 includes two outwardly projecting tabs 62 that are spaced from the top surface of the upper edge 52, such that they sit flat against the underside of the fixture plate 26, as shown in FIG. 9. Screws 64 are then inserted through screw holes 66 in the tabs 62, securing the storage device 44 to the fixture plate 26, with the lid 50 projecting out of the upper side 68. The body 46 sits within the opening 36, against the stepped edge 38, with its upper edge 53 aligning with the ledge 40. This results in the lid 50 being able to close onto the ledge 40 so that the lid 50 sits flush with the upper parting surface 24.

Typically, the fixture plate would be injection moulded from ABS and the storage device would be injection moulded from polypropylene, however it will be appreciated that any suitable materials may be used.

The advantage of the present invention is that a storage device 44 can be fully housed with a mannequin component, such that the repair items are always located with the correct mannequin and are readily at hand when needed.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A mannequin component having at least one parting surface for joining to at least one other mannequin component, the parting surface having an opening into a void in said mannequin component, said opening being sized and shaped to receive a storage device including a body having a receptacle for receiving items associated with said mannequin component, and a lid for closing the receptacle to enclose said items within the storage device, the storage device further including a holding fixture for securing the body to the mannequin component, the holding fixture including at least one screw adapted to be received in an aperture in a fixture plate provided in a parting surface of the mannequin component.

2. The mannequin component according to claim 1, wherein said mannequin component is a leg, arm, hip section or torso.

3. The mannequin component according to claim 1, wherein the parting surface of the mannequin component includes a fixture plate that is secured onto or, into the parting surface.

4. The mannequin component according to claim 3, wherein the fixture plate includes a mechanical connector or connectors to fix two mannequin components together.

5. The mannequin component according claim 3, wherein the fixture plate includes said opening into a void of the mannequin component.

6. The mannequin component according to claim 5, wherein the opening is sized and shaped to receive the storage device, such that the storage device is substantially flush with the parting surface to allow for connection of components.

7. The mannequin component according to claim 3, wherein the fixture plate is circular in shape and fits within a corresponding aperture in the mannequin component surface.

8. The mannequin component according to claim 3, wherein the fixture plate is injection moulded from a thermoplastic.

9. The mannequin component according to claim 8, wherein the fixture plate is injection molded from acrylonitrile butadiene styrene.

10. The mannequin component according to claim 1, wherein the receptacle has a cross-sectional shape resembling a symmetrical kidney.

11. The mannequin component according to claim 1, wherein the receptacle is of greater length than cross-sectional width or depth, the length extending into the mannequin component cavity.

12. The mannequin component according to claim 1, being injection moulded out of polypropylene.

13. The mannequin component according to claim 1, wherein the lid is integrally moulded with the body to form a live hinge.

14. The mannequin component according to claim 13, further including a closing mechanism to secure closure of the lid.

15. The mannequin component according to claim 14, further including a finger hole to enable opening by pulling away from the closing mechanism.

16. A first mannequin component having at least one parting surface for joining to at least one other mannequin component, the parting surface having an opening into a void in said first mannequin component, wherein a storage device is located in said void opening, said storage device including a body having a receptacle for receiving items associated with said mannequin component, and a lid for closing the receptacle to enclose said items within the storage device, including a body having a receptacle for receiving items associated with said mannequin component, and a lid for closing the receptacle to enclose said items within the storage device, the storage device further including a holding fixture for securing the body to the mannequin component, the holding fixture including at least one screw adapted to be received in an aperture in a fixture plate provided in a parting surface of the mannequin component.

* * * * *